United States Patent [19]

Sasao et al.

[11] 4,264,795

[45] Apr. 28, 1981

[54] SWITCHING DEVICE

[75] Inventors: Hiroyuki Sasao; Yoshihiro Ueda; Hajimu Yoshiyasu; Soichiro Okuda, all of Amagasaki, Japan

[73] Assignee: Mitsubishi Denki Kabushiki Kaisha, Tokyo, Japan

[21] Appl. No.: 21,249

[22] Filed: Mar. 16, 1979

[30] Foreign Application Priority Data

Mar. 17, 1978 [JP] Japan ..... 53-31286

[51] Int. Cl.[3] ..... H01H 33/95

[52] U.S. Cl. ..... 200/148 R; 200/148 B; 200/150 D

[58] Field of Search ..... 200/148 R, 148 A, 148 B, 200/148 C, 148 O, 149 A, 150 R, 150 A, 150 L, 150 G, 144 A

[56] References Cited

U.S. PATENT DOCUMENTS

| | | | |
|---|---|---|---|
| 4,032,736 | 6/1977 | Ruffieux | 200/147 R |
| 4,139,752 | 2/1979 | Itai et al. | 200/148 R |
| 4,218,597 | 8/1980 | Kii | 200/148 R |

FOREIGN PATENT DOCUMENTS

| | | | |
|---|---|---|---|
| 2282711 | 3/1976 | France . | |
| 703101 | 1/1954 | United Kingdom | 200/144 A |

*Primary Examiner*—James R. Scott

*Attorney, Agent, or Firm*—Wenderoth, Lind & Ponack

[57] ABSTRACT

An outer arc extinguishing compartment is disposed coaxially with an inner arc extinguishing compartment and partly projects under one end thereof. A movable contact member extends through both compartments and separably engages a stationary contact member located within the inner compartment. A plurality of arc suppressors of spindle-shaped cross section are disposed at equal angular intervals in the projecting portion of the outer compartment adjacent to and about the movable contact member to extend axially and radially of the latter. The circumferential minimum distance between the arc suppressors is smaller than the diameter of a positive column of an electric arc struck across both contact members.

10 Claims, 2 Drawing Figures

SWITCHING DEVICE

BACKGROUND OF THE INVENTION

This invention relates to a switching device, and more particularly to an arc self-extinguishing switch device for self-extinguishing an electric arc established across a pair of contact members through the utilization of a gas expanded with heat generated by the electric arc.

There have been recently developed simple, highly economical switch devices of the above type including an amount of an arc extinguishing fluid such as gaseous sulfur hexafluoride ($SF_6$) filling an arc extinguishing compartment having a suitable volume and operative to place the are extinguishing fluid under a high pressure through the utilization of the pressure increasing action resulting from thermal energy mainly provided by the electric arc itself and to extinguish the electric arc by delivering the fluid forming a high pressure source to an arc space in the process of decreasing the resulting arc current to a null magnitude.

In conventional switching devices of the type referred to, it is indispensable to increase the pressure of the arc extinguishing fluid within the pressure increasing compartments at a temperature as low as possible. This is because the pressure of the arc extinguishing fluid rises with thermal energy resulting from the particular electric arc itself. When the electric arc enters into the pressure increasing compartment, the pressure of the arc extinguishing fluid is apt to rise, but a disadvantage has been caused in that the temperature of the arc extinguishing fluid is prone to rise, thus resulting in that the arc extinguishing performance is reduced.

Accordingly, it is an object of the present invention to provide a new and improved switching device operative to maintain an amount of an arc extinguishing fluid at a temperature as low as possible, which fluid charges a pressure increasing compartment and increases in pressure upon the occurrence of an electric arc while being highly capable of performing the arc interrupting or extinguishing operation.

SUMMARY OF THE INVENTION

The present invention provides a switching device comprising, in combination, a housing filled with an amount of an arc extinguishing fluid, a plurality of arc extinguishing compartments disposed within the housing, each of the arc extinguishing compartments being filled with an amount of the arc extinguishing fluid, a pair of contact members disposed in a selected one of the arc extinguishing compartments to be separably engaged with each other, at least one of the contact members being movable, the separation of the contact members establishing an electric arc thereacross, and a plurality of arc suppressors disposed at a boundary between another selected one of the arc extinguishing compartments including the arc extinguishing fluid having a pressure increased by the electric arc and a space having the electric arc established therein.

BRIEF DESCRIPTION OF THE DRAWING

The present invention will become more readily apparent from the following detailed description taken in conjunction with the accompanying drawings in which.

DESCRIPTION OF THE PREFERRED EMBODIMENT

Figure 1:
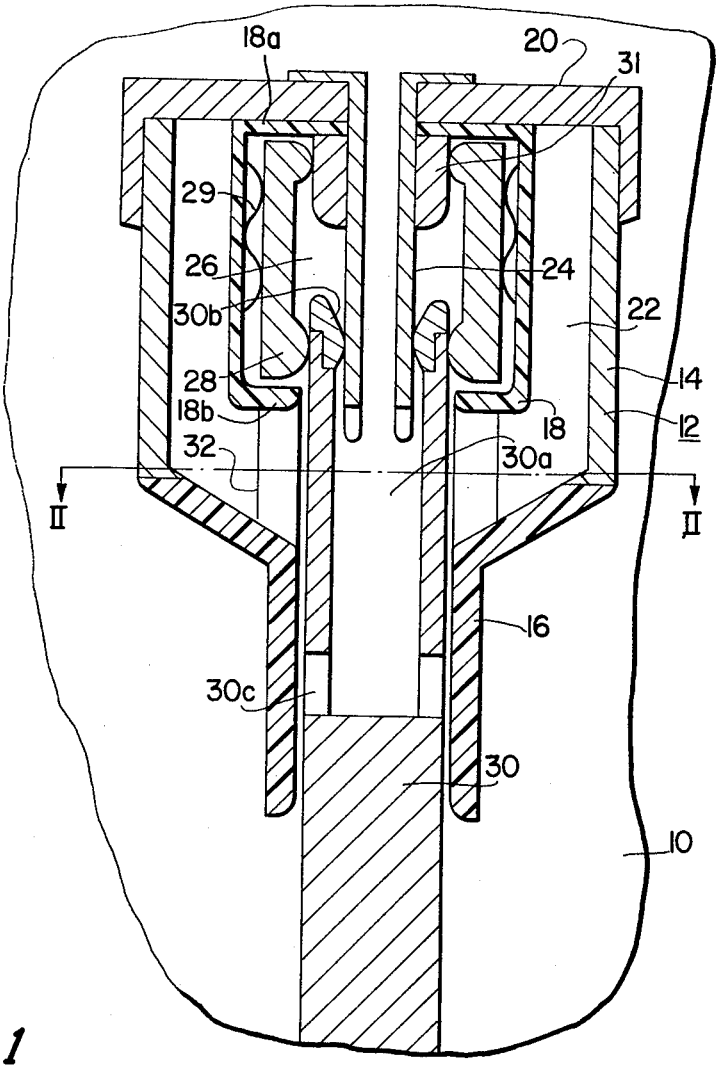
FIG. 1 is a fragmental longitudinal sectional view of one embodiment according to the switching device of the present invention.

Referring now to FIG. 1 of the drawing, there is illustrated one embodiment according to the switching device of the present invention. The arrangement illustrated comprises a housing 10 filled with an amount of an arc extinguishing fluid such as gaseous sulfur hexafluoride ($SF_6$) and a first envelope generally designated by the reference numeral 12 including a hollow metallic cylinder 14 having a relatively large diameter and a flow guide 16 formed into a funnel of an arc resisting, electrically insulating material and connected at the larger diameter end to one end, in this case the lower end as viewed in FIG. 1, of the hollow cylinder 14. The flow guide 16 includes a lower end portion in the form of a hollow cylinder having a smaller diameter and directed downward as viewed in FIG. 1. A second envelope 18 in the form of a hollow cylinder is disposed within the hollow envelope cylinder 14 to be substantially coaxial with the latter. The second envelope 18 is provided at one end, in this case the upper end as viewed in FIG. 1, with an end plate **18*a* having a small central aperture and at the other or lower end with a radially inwardly directed flange 18*b* defining a central opening having a diameter equal to the inside diameter of and located directly above the smaller diameter portion of the flow guide 16. The second envelope 18** is composed of an arc resisting electrically insulating material along with the bottom plate and flange.

As shown in FIG. 1, an apertured metallic terminal plate 20 in the form of a tray is hermetically attached to the other or upper end of the first envelope 12 and has its inner surface fixedly secured to the outer surface of the end plate **18*a* of the second envelope 18 with the central aperture of the terminal plate 20 aligned with that of the end plate 18*a* of the second envelope 18. Thus a first arc extinguishing compartment 22 is defined by the first and second envelopes 12 and 18, the terminal plate 20 and a movable contact member 30 movably extending through both the smaller diameter portion of the flow guide 16 and the opening in the flange 18*b* of the second envelope 18 as will be described hereinafter. The first arc extinguishing compartment 22 is also filled with an amount of arc extinguishing fluid, for example, gaseous sulfur hexafluoride ($SF_6$). Further, a hollow cylindrical arc contact member 24 having both ends open is extended and sealed through the aligned central apertures in the terminal plate 20 and the end plate of the second envelope 18 by having a radially outwardly directed flange fixedly secured to the outer surface of the terminal plate 20. The arc contact member 24 runs in coaxial relationship within the second envelope 18 in a downward direction as viewed in FIG. 1 and terminates at a position somewhat extending beyond the flange 18*b* of the second envelope 18. Thereby a second arc extinguishing compartment 26 is defined by the second envelope 18 and the arc contact member 24 to be substantially coaxial with the first arc extinguishing compartment 22** and also is filled with an amount of an arc extinguishing fluid such as gaseous sulfur hexafluoride ($SF_6$).

Fixedly disposed, e.g. by spring 29, within the second envelope 18 is a stationary contact member 28 electrically connected to the terminal plate 20 through a connecting member 31 and the arc contact member 24 as shown in FIG. 1. The stationary contact member 28 is of the finger contact type. Movable contact member 30 in its closed position extends coaxially through the first and second envelopes 12 and 18 respectively until it is separably engaged by the stationary contact member 28. More specifically, the movable contact member 30 includes one end portion formed into a hollow cylinder 30*a* extending through a substantial part of the smaller diameter portion of the flow guide 16 of the first envelope 12 and the central opening in the flange 18*b* of the second envelope 18 with minute annular gaps left therebetween and terminating at a flared open end 30*b* which reaches the second arc extinguishing compartment 26. In its closed position, the flared open end 30*b* includes an inner wall surface engaging the outer surface of the arc contact member 24 and an outer wall surface engaging the stationary contact member 28 in the second arc extinguishing compartment 26. The movable contact member 30 includes a plurality of radial vent or exhaust holes 30*c* radially extending at equal angular intervals through the wall of the other end portion of the hollow cylinder 30*a* remote from the flared open end 30*b*. These radial exhaust holes 30*c* are blocked by the smaller diameter portion of the flow guide 16 when the movable contact member 30 is in its closed position and permit the first and second arc extinguishing compartments 22 and 26 respectively to communicate with the housing 10 through the open end 30*b* when the contact member 30 is in its open position.

The present invention utilizes the fact that it is difficult for electric arcs to enter a space having a dimension smaller than the diameter of the positive column of the arc, i.e. the diameter of the arc portion through which an associated arc current flows, and provides a plurality of arc suppressors disposed at a boundary between an arc extinguishing compartment where an electric arc is established and another arc extinguishing compartment responsive to the electric arc to raise the pressure of an arc extinguishing fluid charged therein.

Figure 2:
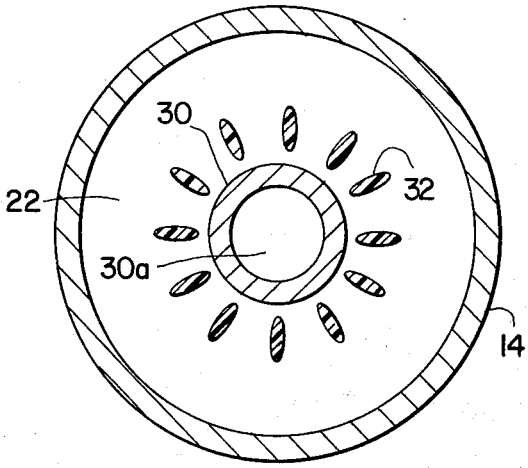
FIG. 2 is a cross sectional view taken along the line II—II of FIG. 1.

More specifically, a plurality of arc suppressors 32 of electrically insulating material are disposed at equal angular intervals at a boundary between the first arc extinguishing compartment 22 and a space in which an electric arc is struck to form a circular array concentric with the longitudinal axis of the first envelope 12 and therefore of the movable contact member 30. That is, the arc suppressors 32 substantially extend between the flange 18*b* of the second envelope 18 and the junction of the truncated conical and cylindrical portions of the flow guide 16 of the first envelope 12 and in the same direction as an axis along which an electric arc involved is established, that is to say, along the longitudinal axis of the movable contact member 30 in its closed position. The arc suppressors 32 include radially inner ends substantially flared with respect to the inner peripheral surface of the cylindrical portion of the flow guide 16 and therefore the inner periphery of the flange of the second envelope 18. As shown in FIG. 2, the arc suppressors 32 have spindle-shaped cross sections extending radially of the movable contact member 30 and therefore of the envelope 12, and each pair of adjacent arc suppressors are circumferentially spaced from each other by a circumferential minimum distance smaller than the diameter of a positive column of an electric arc established when the movable contact member disengages from the stationary contact member 28. This measure prevents the electric arc from entering the first arc extinguishing compartment 22.

When receiving a trip signal, an operating mechanism (not shown) connected to the other end of the movable contact member 30 starts the latter to be moved in the downward direction as viewed in FIG. 1. During this downward movement the movable contact member 30 disengages from the stationary contact member 28 whereupon an electric arc is struck across both contact members. When the movable contact member 30 continues to descend, one root of the electric arc is transferred from the stationary contact member 28 to the arc contact member 24 and then the electric arc is elongated whereby an arc space is spread or looped. Under these circumstances, thermal energy provided by the electric arc serves to increase pressures of the arc extinguishing fluid within the arc extinguishing compartments 22 and 26, that is to say, to accumulate the pressures in those compartments. On the other hand, only a relatively low temperature portion of the electric arc itself is permitted to enter the first arc extinguishing compartment 22, but a hot portion thereof is prevented from entering compartment 22 because the circular array of the arc suppressors 32 is disposed between the first extinguishing compartment 22 and the space having the electric arc established therein.

At that time, the electric arc maintains the first arc extinguishing compartment 22 in a blocked state and therefore the pressure required for the later extinction of the electric arc is reached within a short time interval without the pressure being released from the compartment 22. Also the hot portion of the electric arc itself is delivered to the housing through the hollow portion of the arc contact member 24.

Then the movable contact member 30 further continues to descend until the radial holes 30*c* therein open into the housing 10. Meanwhile, the resulting arc current reaches its null magnitude, whereupon the first arc extinguishing compartment 22 is released from being blocked by the electric arc. Therefore the pressure within the arc extinguishing compartment 22 is left to discharge with the result that the arc extinguishing fluid from the compartment 22 blowing against the electric arc is at a low temperature and has sufficient ability to extinguish the electric arc. Accordingly, the electric arc is rapidly extinguished.

From the foregoing it is seen that the present invention provides a plurality of arc suppressors disposed at a boundary between a space in which an electric arc is established and an arc extinguishing compartment within which the pressure of an arc extinguishing fluid is increased by means of the electric arc. Thus the arc extinguishing fluid can rapidly increase in pressure while it is maintained at a low temperature and the arc interrupting or extinguishing capability or performance is improved.

While the present invention has been illustrated and described in conjunction with a single preferred embodiment thereof it is to be understood that numerous changes and modifications may be resorted to without departing from the spirit and scope of the present invention. For example, the arc suppressors may have any desired number, and any desired cross sectional profile other than illustrated so long as each pair of adjacent arc suppressors are circumferentially spaced from each other by a circumferential distance smaller than the diameter of the positive column of electric arcs involved. By selecting properly the number and cross sectional profile of the arc suppressors, the interruption operation can be performed over a wide range of currents. Also, the present invention is equally applicable to switching devices including more than two of the arc extinguishing compartments.

What we claim is:

1. A switching device comprising:

a housing having an interior filled with an arc extinguishing fluid;

a first arc extinguishing compartment provided within said housing separate from said interior thereof, said first arc extinguishing compartment being filled with an arc extinguishing fluid;

a second arc extinguishing compartment provided within said housing, separate from said interior thereof and at a location adjacent said first arc extinguishing compartment, said second arc extinguishing compartment being filled with an arc extinguishing fluid;

first contact member means positioned within said second arc extinguishing compartment;

second contact member means, movable from a closed first position in contact with said first contact member means toward an open second position spaced from said first contact member means, for, upon movement of said second contact member means away from said first contact member means, establishing an electric arc between said first and second contact member means within a space adjacent and communicating with said first arc extinguishing compartment and through which said second contact member means moves, and for increasing the pressure of said arc extinguishing fluid within said second arc extinguishing compartment; and a plurality of arc suppressor means, positioned at a boundary between said first arc extinguishing compartment and said space, for preventing said electric arc from entering said first arc extinguishing compartment and from substantially increasing the temperature of said arc extinguishing fluid therein, whereupon when the current forming said electric arc reaches its null magnitude, said arc extinguishing fluid is discharged from said first and second arc extinguishing compartments at a sufficiently high pressure and at a sufficiently low temperature to rapidly extinguish said electric arc.

2. A device as claimed in claim 1, wherein said first contact member means is stationary within said second arc extinguishing compartment.

3. A device as claimed in claim 1, wherein said first and second arc extinguishing compartments are positioned substantially coaxially with respect to each other.

4. A device as claimed in claim 1, wherein each of said arc suppressor means extends axially and radially of a longitudinal axis along which said electric arc is established.

5. A device as claimed in claim 4, wherein each adjacent pair of said arc suppressor means are spaced from each other circumferentially of said longitudinal axis by a distance less than the diameter of a positive column of said electric arc.

6. A device as claimed in claim 1, wherein each said arc suppressor means is formed of an electrically insulating material.

7. A device as claimed in claim 1, wherein said arc extinguishing fluid comprises gaseous sulfur hexafluoride ($SF_6$).

8. A device as claimed in claim 1, wherein said second contact element means includes a portion in the form of a hollow cylinder having an open first end adapted to be located within said second arc extinguishing compartment when said second contact element means is in said closed first position and a second end having a plurality of radial exhaust holes, and further comprising means forming a portion of said first arc extinguishing compartment for blocking communication through said radial exhaust holes to said interior of said housing when said second contact element means is in said closed first position, and said radial exhaust holes being positioned to provide communication to said interior of said housing when said second contact element means is in said open second position.

9. A device as claimed in claim 1, wherein said second arc extinguishing compartment is defined between an inner envelope member formed of an electrically insulating material and a hollow arc contact member extending coaxially through said inner envelope member, said hollow arc contact member having open opposite ends, said first contact member means being positioned between said inner envelope member and said hollow arc contact member, and adjacent first ends of said inner envelope member and said hollow arc contact member defining therebetween a clearance through which extends said second contact member means when in said closed first position.

10. A device as claimed in claim 9, wherein said first arc extinguishing compartment is substantially defined between said inner envelope member and an outer envelope member substantially coaxially surrounding said inner envelope member, said outer envelope member including a portion formed of an electrically insulating material, and said arc suppressor means comprise members formed of an electrically insulating material and extending between said first end of said inner envelope member and said portion of said outer envelope member.

* * * * *